US006006909A

United States Patent [19]

Dunne

[11] Patent Number: 6,006,909

[45] Date of Patent: Dec. 28, 1999

[54] SELF-CONTAINED HANGER FOR COILED ROPE PACKAGE

[75] Inventor: James G. Dunne, Palos Heights, Ill.

[73] Assignee: Aamstrand Ropes & Twines, Inc., Manteno, Ill.

[21] Appl. No.: 09/138,381

[22] Filed: Aug. 24, 1998

[51] Int. Cl.[6] ..... B65D 75/00

[52] U.S. Cl. ..... 206/388; 206/497; 242/163; 242/166; 53/430; 53/413; 53/442

[58] Field of Search ..... 206/388, 49, 410, 206/497; 242/163, 164, 166; 53/430, 413, 442, 116, 137.1, 557

[56] References Cited

U.S. PATENT DOCUMENTS 1,628,244 5/1927 Hoos ..... 242/164
3,997,122 12/1976 Helfand et al. ..... 242/166 X
4,688,674 8/1987 Stirtz ..... 206/388
5,147,040 9/1992 Koike et al. ..... 206/497

*Primary Examiner*—Jacob K. Ackun
*Attorney, Agent, or Firm*—Knechtel, Demeur & Samlan

[57] ABSTRACT

A rope package designed and configured with a self-contained hanger for display in retail stores. The rope is designed to be coiled into a number of uniform coils. In coiling the rope, one coil is pulled away from the uniform coils to create a loop between the one coil extending outwardly and the other uniform coils. The coiled configuration is then wrapped tightly with a membrane to hold the coiled configuration together. The resulting rope package contains a self-contained hanger, through use of the loop, that is suitable for hanging for display in its individual capacity in retail stores.

7 Claims, 1 Drawing Sheet

SELF-CONTAINED HANGER FOR COILED ROPE PACKAGE

I. FIELD OF THE INVENTION

The present invention relates to rope packaging and, more particularly, to the design and method for producing a coiled rope package that can be hung for display using a self-contained hanger within the coiled rope.

II. DESCRIPTION OF THE PRIOR ART

In today's global marketplace, the success and survivability of a product hinges upon many factors. One of the most important is marketing. In fact, companies spend millions of dollars each year in marketing their products. The companies pursue this task through commercial advertising of the product, its trademarks, and trade dress. The cornerstone of marketing is, therefore, the process of attracting public attention to the product.

In the past, various types of ropes have been marketed and displayed throughout the retail trade. The majority of these ropes are sold in package type configurations. Due to their natural unmanageable length, the ropes are coiled into lengths and shapes that are manageable. Typically, the shapes of the coiled ropes are rectangular or circular. The coiled ropes, in their rectangular or circular shapes, are then tightly held together through twine or a shrinkwrap of some fashion. The coiled ropes and wrapping combine to produce a rope package suitable for sale.

A problem with the current rope packages sold today is that they are not conducive for display in retail stores and, therefore, the marketing of the rope product is unnecessarily restrictive. The rope packages are usually grouped together and placed in containers such as boxes, bins, or baskets. As a result, the rope packages are poorly displayed which hinders consumers in locating the rope packages that they desire to purchase. Consumers are additionally frustrated if all the different lengths and shapes of the rope packages are grouped together and placed in the same containers.

Subsequently, manufacturers designed a way to display a number of rope packages in a hanging manner. This consisted of grouping a number of rope packages of similar lengths and shapes and placing them in bags which are open at the top and closed at the bottom. At the top portion, each of the bags contained either holes or a string within the bag itself for sustaining the grouping of rope packages in a hanging type manner. An inherent drawback of this assembly is that the rope packages are sold in groups, not individually. A consumer must then pay a higher price for an undesired surplus of ropes.

Thereafter, manufacturers designed a way to individually hang rope packages. A separate piece is affixed to each rope package. Each piece is in the form of a hook such as an 'S' hook. The bottom portion of the piece is attached to the exterior of the rope package and the hook at the top portion of the piece is suspended in a hanging manner vertically from peg boards and shelves along the display. A shortcoming of this assembly is that a separate piece is necessary and must, subsequent to the packaging of the rope, be affixed to the rope itself. As a consequence, the integrity of a new rope and its lifespan is impaired which creates an inferior product prior to being purchased by the consumer. The separate piece, if plastic, can also be easily broken or, if of a stronger material is used, susceptible to bending. In either instance, however, the individual rope package is no longer suitable for display in a hanging manner and, therefore, must be sold in one of the alternate embodiments previously discussed.

There is a need, therefore, for a rope package that can be individually hung for display using a self-contained hanger within the rope package for effective marketing and increased public attention to the product. Accordingly, applicant's invention provides a rope package designed to accommodate such a purpose.

III. OBJECTS OF THE INVENTION

It is the primary object of the present invention to provide a self-contained hanger within a coiled rope package for individually displaying the rope product in a vertical hanging manner. A related object of the present invention is to provide an improved marketing visibility for rope products.

Another object of the invention is to sell a rope product that is not converted into an inferior product simply by the manner in which it is displayed in retail stores. A related object of the invention is to avoid the unnecessary attachment of separate pieces to the rope for hanging purposes that must be removed following the purchase of the product.

Still another object is to provide retailers a rope package that is economical and easy to display.

Other objects of the present invention will become more apparent to persons having ordinary skill in the art to which the present invention pertains from the following description taken in conjunction with the accompanying drawings.

IV. SUMMARY OF THE INVENTION

The above objects of the present invention are provided for in a coiled rope package having a self-contained hanger within the rope package. According to the invention, a rope is coiled into a uniform length and shape. During the coiling of the rope into a uniform length and shape, one coil is pulled from and displaced a small distance away from the other coils along the same axis as the rope is being coiled. The combination of the one extended coil and the remaining coils creates a loop. Following the completion of coiling the rope, the coiled rope, excluding the loop, is wrapped with a membrane to tightly hold the coiled rope together and, thereby, forming a coiled rope package suitable for sale in retail stores.

V. BRIEF DESCRIPTION OF THE DRAWINGS

VI. DETAILED DESCRIPTION OF THE PREFERRED EMBODIMENT

Figure 1:
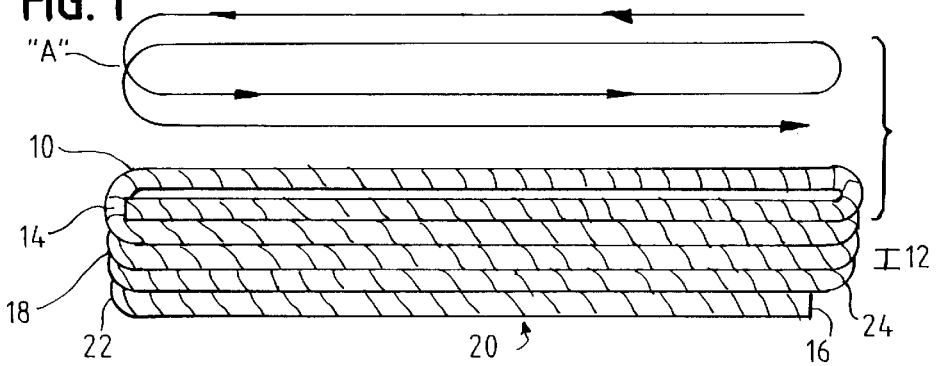
FIG. 1 is a side view of applicant's invention showing the coiling of a rope.
Figure 5:
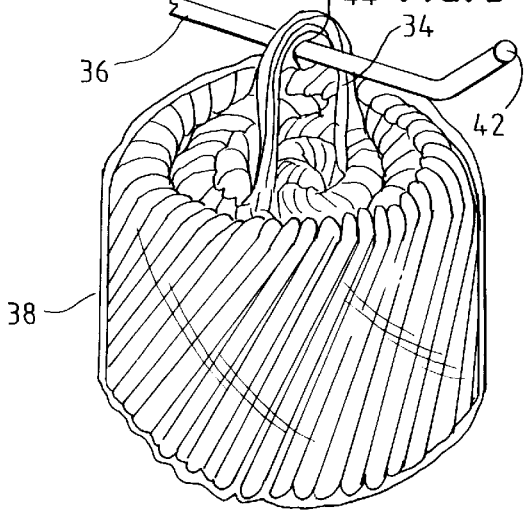
FIG. 5 is an example of an alternate embodiment for coiling the rope.

Turning first to FIG. 1, a representative example of a rope 10 is depicted. The thickness 12 and the length from point 14 to point 16 of the rope 10 is variable and preferably remains at the discretion of the manufacturer. The rope 10 is shown being coiled into a number of coils 18. The directional flow "A" of the coiling of the rope 10 is illustrated. In the preferred embodiment, the directional flow "A" is counter-clockwise. Alternatively, the directional flow "A" could be clockwise. In either instance, however, the directional flow "A" should preferably remain constant throughout the coiling of the rope 10. The constant coiling enables the coiling of the rope 10 to be as compact as possible while providing a rope product free from entanglements. The coils 18 are coiled into an elongated form or rectangular shape. Alternatively, the rope 10 could be coiled into any other type of shape including but not limited to a circle (FIG. 5). The coils 18 are coiled into a coiled length 20 as measured from point 22 to point 24. Each coil 18 is coiled into approximately the same coiled length 20. Additionally, the coiled length 20 of the coils is variable. As a result, the number of coils 18 will be variable depending upon the thickness 12 and length of the rope 10 from point 14 to point 16. Given the thickness 12 and the length of the rope 10 from point 14 to point 16, the rope 10, preferably, should be of sufficient length for easiest packaging and handling by the consumer. This combination provides the manufacturer with a more marketable rope product for the consumer.

Figure 2:
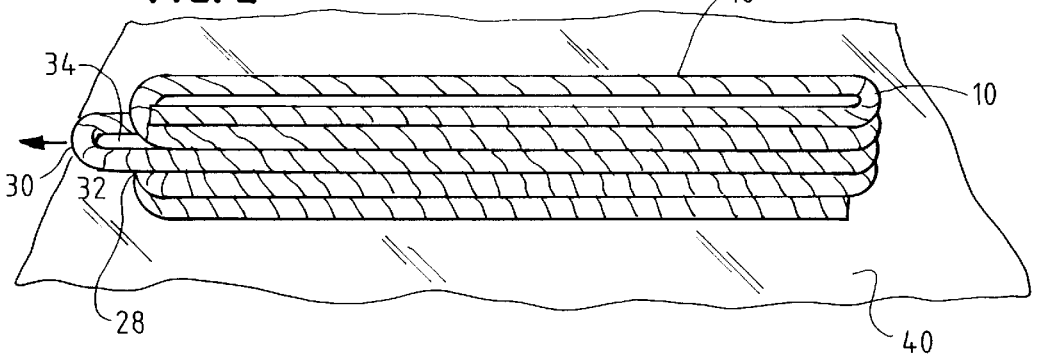
FIG. 2 is a side view of the coiled rope showing the creation of the self-contained hanger within the coiling of the rope.

Turning to FIG. 2, a side view of the rope 10 coiled showing the self-contained hanger 26 is depicted. Upon the coiling of the rope 10, one of the coils 18 is pulled from coiled point 28 to finished point 30. The difference between coiled point 28 and the finished point 30 is a resulting distance 32. Upon the coil 18 being pulled a resulting distance 32, a loop 34 is created. The resulting distance 32 is variable, but preferably should be a small fraction of the coiled length 20 of the rope 10. The resulting distance 32, however, should be of sufficient length such that the loop 34 is large enough for an arm 36 (FIG. 4) to fit through the loop 34 inbetween the coiled point 28 and the finished point 30. This facilitates use of the loop 34 as a hanger. Applications for the loop 34 as a hanger include but are not limited to slipping the loop 34 over a peg in a pegboard, a metal arm such as an 'L' bracket along an isle in a retail store, or any other similar type of device used for hanging products for display.

Figure 3:
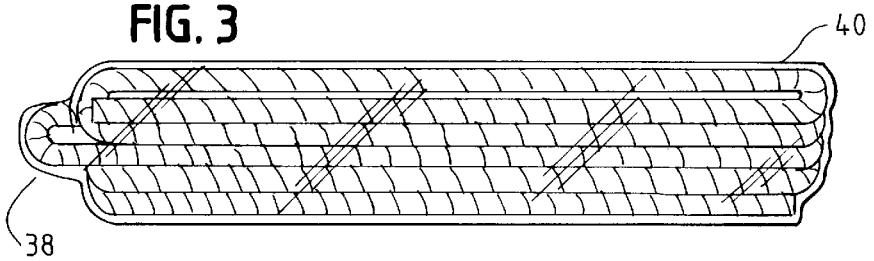
FIG. 3 is a side view of the coiled rope in its assembled configuration illustrating the coiled rope with the self-contained hanger all held together by a membrane in its packaged form.

Turning to FIG. 3, the assembled rope package 38 is displayed. The rope 10 coiled with one coil 18 creating the loop 34 is tightly held together by a membrane 40. In its preferred embodiment, the membrane 40 covers every port ion of the rope 10, excluding the portion of the coil 18 from the coiled point 28 to the finished point 30 and the resulting loop 34. Alternatively, the membrane 40 could cover every portion of the rope 10 including the portion of the coil 18 from the coiled point 28 to the finished point 30 and the resulting loop 34. In the latter embodiment, the coil 18 that extends from the coiled point 28 to the finished point 30 will be protected from the elements to preserve the integrity of the rope 10. Moreover, the membrane 40 will be less susceptible to tearing while the rope package 38 is being transported and displayed. For application as a hanger, the membrane 40 would then need to be punctured within the loop 34 to create an opening. The membrane 40 is preferably transparent for visibility of the rope product. This serves to enhance the marketability of the rope product and permit the consumer to see the product that their purchasing. The membrane 40 is also preferably made of plastic. A good example of a membrane 40 includes but is not limited to shrink wrap.

In an alternate embodiment, the rope package 38 does not require the use of a membrane 40 to tightly hold the rope package 38 together. In lieu of the membrane 40, the rope 10 could simultaneously serve to secure itself in its own rope package 38. Moreover, although less desirable, a second rope, twine, or some variation thereof may be used. In the former, the coils 18 could be coiled into a length 20 such that a portion of the rope 10 remains uncoiled. Preferably, this portion should contain a free end of the rope 10, either point 14 or point 16. This uncoiled portion may then be cross coiled or perpendicularly coiled around the coils 18, from point 22 to point 24, excluding the portion of the coil 18 from the coiled point 28 to the finished point 30 and the resulting loop 34. Whichever portion of the rope 10 is used, the free end, point 14 or point 16 should not remain exposed as the integrity of the rope package. 38 will be vulnerable to loosening or unraveling and render the loop 34 ineffective. Instead, point 14 or point 16 should be tucked within the coiling of the rope package 38. As a result of the cross coiling and the free end tucked, the rope 10 is converted into a self-restraining rope package 38 and, thereby, obviate the need for a surrounding membrane 40 or other similar variations thereof. Additionally, by eliminating the membrane 40, the costs for manufacturing the rope package 38 are reduced.

Figure 4:
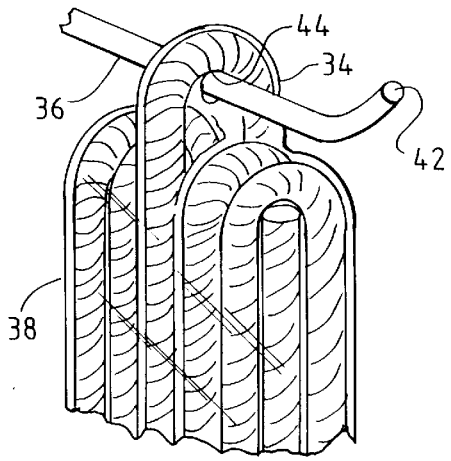
FIG. 4 is a perspective view of a rope package as it is hung for display in retail stores.

Turning to FIGS. 4 and 5, the rope package 38 is shown being hung from an arm 36. The arm 36, having a diameter 42, is inserted through the loop 34 at an entranceway 44. In the preferred embodiment, the entranceway 44 is as large as the loop 34. Alternatively, if the coil 18 and the loop 34 are covered by the membrane 40, then the entranceway 44 will be as large as the diameter 42 of the arm 36. As illustrated in FIGS. 1–4, the rope package 38 was coiled into a rectangular shape. Another option, however, could be to coil the rope package 38 into any other shape including but not limited to a circle as illustrated in FIG. 5.

Thus, there has been provided a rope package designed and configured with a self-contained hanger for display in its individual capacity. While the invention has been described in conjunction with a specific embodiment, it is evident that many alternatives, modifications and variations will be apparent to those skilled in the art in light of the foregoing description. Accordingly, it in intended to embrace all such alternatives, modifications and variations as fall within the spirit and scope, of the appended claims.

What is claimed is:

1. A self-contained hanger for a coiled rope package comprising:

a coiled rope, the rope having an inner set of coils and an outer set of coils, the inner set of coils having one coil extending outwardly from the inner set to form a loop, the outer set of coils traversing the inner set of coils, the traversing being perpendicular to the inner set of coils and covering a significant portion of the length of the inner set of coils restricting the movement of the inner set of coils to forming a package configuration.

2. A self-contained hanger for a coiled rope package comprising:

a rope, the rope arranged in a coiled shape, the coiled shape having a number of coils with one coil extending outwardly from the coiled shape to form a loop;

a membrane wrapped tightly about the coiled shape to form a package configuration, the loop created by the coil extending outwardly from the coiled shape remaining unwrapped and free from the surrounding membrane thereby configuring the package to be displayed in a hanging manner for marketing purposes.

3. The self-contained hanger for a coiled rope package of claim 2 wherein the membrane is a shrink package.

4. A self-contained hanger for a coiled rope package comprising:

a coiled rope, the rope having an inner set of coils and an outer set of coils, the inner set of coils each elongated and equally sized with one coil extending outwardly from the inner set to form a loop, the outer set of coils traversing the inner set of coils, the traversing being perpendicular to the elongated inner set of coils and covering a significant portion of the length of the inner set of coils restricting the movement of the inner set of coils;

a membrane wrapped tightly about the coiled rope to form a package configuration, the loop created by the coil extending outwardly from the inner set of coils remaining unwrapped and free from the surrounding membrane thereby configuring the package to be displayed in a hanging manner for marketing purposes.

5. The self-contained hanger for a coiled rope package of claim 4 wherein the coiled rope is synthetic.

6. The self-contained hanger for a coiled rope package of claim 4 wherein the membrane is a transparent form-fitting plastic wrapping.

7. Method of creating a self-contained hanger for a coiled rope package comprising the steps of:

coiling the rope to produce a coiled rope;

pulling one coil of the coiled rope a small distance from the coiled rope to produce a self-contained loop within the coiled rope;

wrapping the coiled rope tightly, excluding the self-contained loop, with a membrane to produce a coiled rope package that can be hung by the self-contained loop.

* * * * *